US012044090B2

(12) United States Patent
Painter

(10) Patent No.: US 12,044,090 B2
(45) Date of Patent: Jul. 23, 2024

(54) PROTECTIVE WELLHEAD SLEEVES

(71) Applicant: Chevron U.S.A. Inc., San Ramon, CA (US)

(72) Inventor: Jay Patrick Painter, League City, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 17/895,859

(22) Filed: Aug. 25, 2022

(65) Prior Publication Data

US 2023/0068274 A1 Mar. 2, 2023

Related U.S. Application Data

(60) Provisional application No. 63/237,238, filed on Aug. 26, 2021.

(51) Int. Cl.
*E21B 33/04* (2006.01)

(52) U.S. Cl.
CPC ..... *E21B 33/04* (2013.01)

(58) Field of Classification Search
CPC ..... E21B 33/04; E21B 33/03
See application file for complete search history.

(56) References Cited

U.S. PATENT DOCUMENTS 3,334,924 A * 8/1967 Todd ..... E21B 33/043 166/348
4,476,935 A * 10/1984 Hynes ..... E21B 29/08 166/383
2021/0396085 A1* 12/2021 Lim ..... E21B 43/10

* cited by examiner

*Primary Examiner* — Dany E Akakpo
(74) *Attorney, Agent, or Firm* — Smith & Woldesenbet Law Group, PLLC

(57) ABSTRACT

A sleeve for protecting a lockdown screw of a wellhead assembly can include a body having an inner surface and an outer surface, wherein the body has a concave curvature, where the body is configured to be disposed within an upper portion of a recess of a component of the wellhead assembly inside of which the lockdown screw is disposed, where the concave curvature of the body is configured to match that of an inner wall of the component, and where the outer surface is configured to isolate the lockdown screw from an environment in a cavity partially formed by the inner surface when the body is disposed in the upper portion of the recess.

20 Claims, 12 Drawing Sheets

PROTECTIVE WELLHEAD SLEEVES

CROSS-REFERENCE TO RELATED APPLICATIONS

This application claims priority under 35 U.S.C. § 119 to U.S. Provisional Patent Application Ser. No. 63/237,238 titled "Protective Wellhead Sleeves" and filed on Aug. 26, 2021, the entire contents of which are hereby incorporated herein by reference.

TECHNICAL FIELD

The present application is related to wellheads and, more particularly, to protective sleeves for wellheads.

BACKGROUND

Wells being stimulated expose lockdown screws (body penetrations that are manipulated often under pressure and exposed to wellbore pressure) to stimulation pressure and erosion. As a result, some of these lockdown screws may be compromised before they are used in subsequent stages of a field operation. When this occurs, issues may arise, which can lead to added costs, damaged equipment, and significant unscheduled downtime. Protecting lockdown screws in a wellhead assembly before they are employed for use can greatly mitigate these adverse issues.

SUMMARY

In general, in one aspect, the disclosure relates to a sleeve for protecting a lockdown screw of a wellhead assembly, where the sleeve includes a body having an inner surface and an outer surface, where the body has a concave curvature, where the body is configured to be disposed within an upper portion of a recess of a component of the wellhead assembly inside of which the lockdown screw is disposed, where the concave curvature of the body is configured to match that of an inner wall of the component, and where the outer surface is configured to isolate the lockdown screw from an environment in a cavity partially formed by the inner surface when the body is disposed in the upper portion of the recess.

In another aspect, the disclosure relates to a wellhead assembly that includes a spool, a lockdown screw, and a sleeve, where the spool has an inner wall with a recess that extends vertically along the inner wall, where the inner wall at the recess has a concave curvature, where the spool has a horizontal aperture disposed in the inner wall toward an upper end of the recess and extending toward an outer wall of the spool, where the lockdown screw is disposed within the horizontal aperture in the spool, where the sleeve is disposed in the recess in the inner wall of the spool, where the sleeve includes a body and a resistance element, where the body has an inner surface and an outer surface, where the body has the concave curvature, where the body is held in place in an upper portion of the recess of the spool by the resistance element, and where the lockdown screw abuts against the outer surface of the body when the sleeve is disposed in the upper portion of the recess.

In yet another aspect, the disclosure relates to a method for protecting a lockdown screw of a wellhead assembly, where the method includes installing the wellhead assembly at a wellbore, where the wellhead assembly includes a spool and a sleeve, where the spool has an inner wall with a recess that extends vertically along the inner wall, where the inner wall at the recess has a concave curvature, where the spool has a horizontal aperture disposed in the inner wall toward an upper end of the recess and extending toward an outer wall of the spool, where the lockdown screw is disposed within the horizontal aperture, where the sleeve is disposed in the recess in the inner wall of the spool, where the sleeve includes a body and a resistance element, where the body has an inner surface and an outer surface, where the body has the concave curvature, where the body is held in place in an upper portion of the recess of the spool by the resistance element, and where the lockdown screw abuts against the outer surface of the body when the sleeve is disposed in the upper portion of the recess, and where the method also includes stimulating the wellbore, where the sleeve protects the lockdown screw while stimulating the wellbore.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DESCRIPTION OF THE INVENTION

Figure 1A:
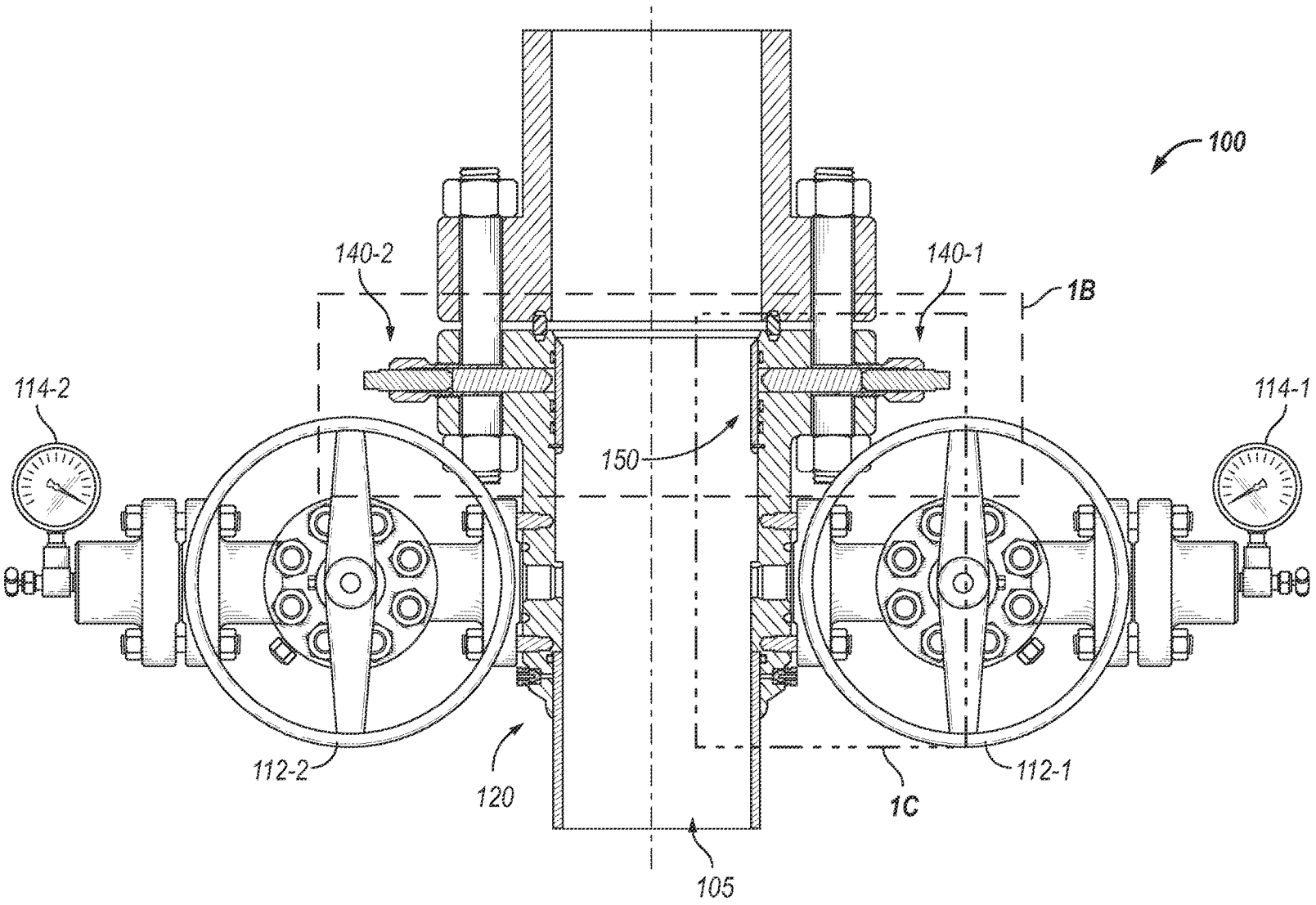
FIGS. 1A through 1C show a sectional view of a portion of a wellhead assembly according to certain example embodiments.

The example embodiments discussed herein are directed to systems, apparatus, methods, and devices for protective wellhead sleeves. Example embodiments can be used in wellhead assemblies for subterranean field operations (e.g., fracture operations, shelf valve simulation, downhole screening). Example sleeves are configured to protect one or more other components of a wellhead assembly from fluids and pressure excursions during subterranean field operations. Examples of such fluids can include, but are not limited to, water, mud, and chemicals. Example embodiments can be used for wellhead assemblies in both land-based and offshore subterranean operations. While example sleeves are described as being used in conjunction with spools (e.g., casing spool, tubing spool) herein, the sleeves can be used with other components of a wellhead assembly that uses lockdown screws and/or other types of expandable devices.

An example sleeve can include one or multiple components, where a component can be made from a single piece (as from a mold or an extrusion or a three-dimensional printing process). When a component (or portion thereof) of an example sleeve is made from a single piece, the single piece can be cut out, bent, stamped, and/or otherwise shaped to create certain features, elements, or other portions of the component. Alternatively, a component (or portion thereof) of an example sleeve can be made from multiple pieces that are mechanically coupled to each other. In such a case, the multiple pieces can be mechanically coupled to each other using one or more of a number of coupling methods, including but not limited to adhesives, welding, fastening devices, compression fittings, mating threads, and slotted fittings. One or more pieces that are mechanically coupled to each other can be coupled to each other in one or more of a number of ways, including but not limited to fixedly, hingedly, rotatably, removably, slidably, and threadably.

Wellhead assemblies that use example embodiments can be designed to comply with certain standards and/or requirements. Examples of entities that set such standards and/or requirements can include, but are not limited to, the Society of Petroleum Engineers, the American Petroleum Institute (API), the International Standards Organization (ISO), and the Occupational Safety and Health Administration (OSHA). Each component of a wellhead assembly (including portions thereof) can be made of one or more of a number of suitable materials, including but not limited to metal (e.g., stainless steel), ceramic, rubber, glass, fibrous material, and plastic.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of sleeves for wellhead assemblies will be described more fully hereinafter with reference to the accompanying drawings, in which example embodiments of sleeves for wellhead assemblies are shown. Sleeves for wellhead assemblies may, however, be embodied in many different forms and should not be construed as limited to the example embodiments set forth herein. Rather, these example embodiments are provided so that this disclosure will be thorough and complete, and will fully convey the scope of sleeves for wellhead assemblies to those of ordinary skill in the art. Like, but not necessarily the same, elements (also sometimes called components) in the various figures are denoted by like reference numerals for consistency.

Terms such as "first", "second", "outer", "inner", "top", "bottom", "above", "below", "distal", "proximal", "front,", "rear," "left," "right," "on", and "within", when present, are used merely to distinguish one component (or part of a component or state of a component) from another. This list of terms is not exclusive. Such terms are not meant to denote a preference or a particular orientation, and they are not meant to limit embodiments of sleeves for wellhead assemblies. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
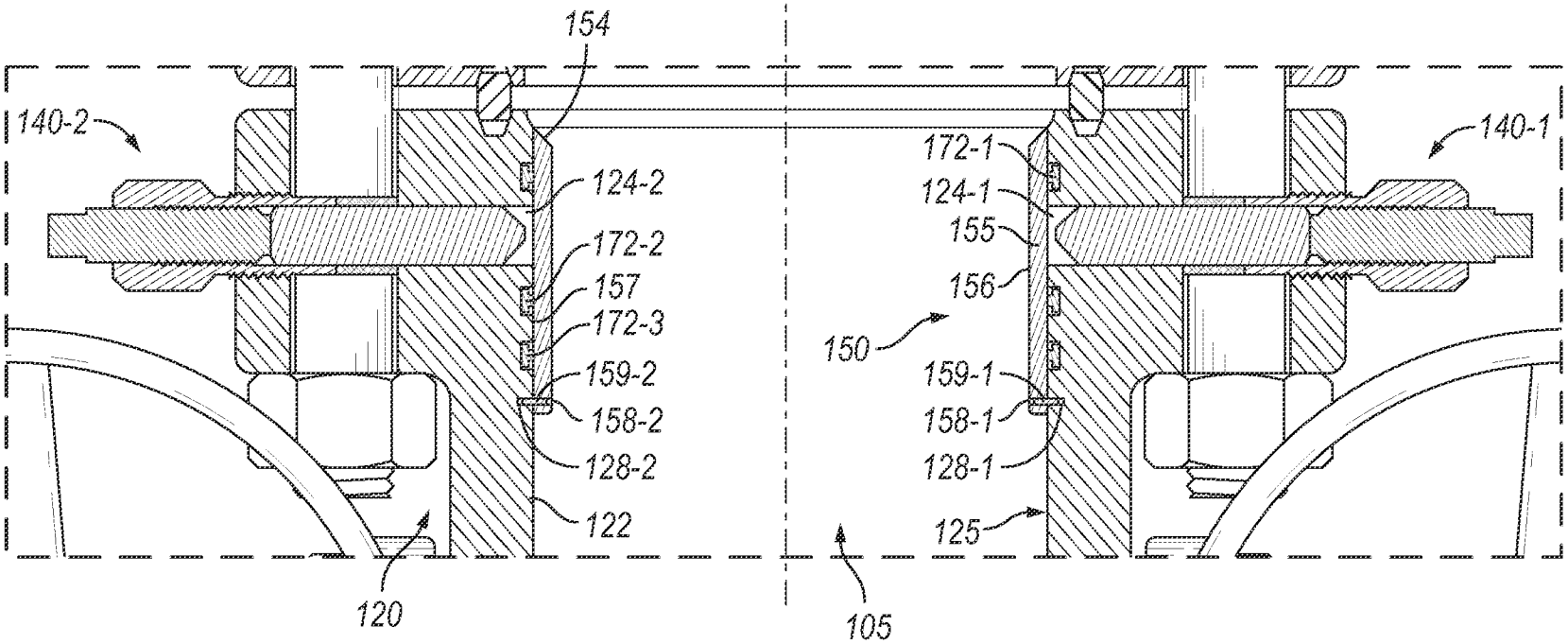
Figure 1C:
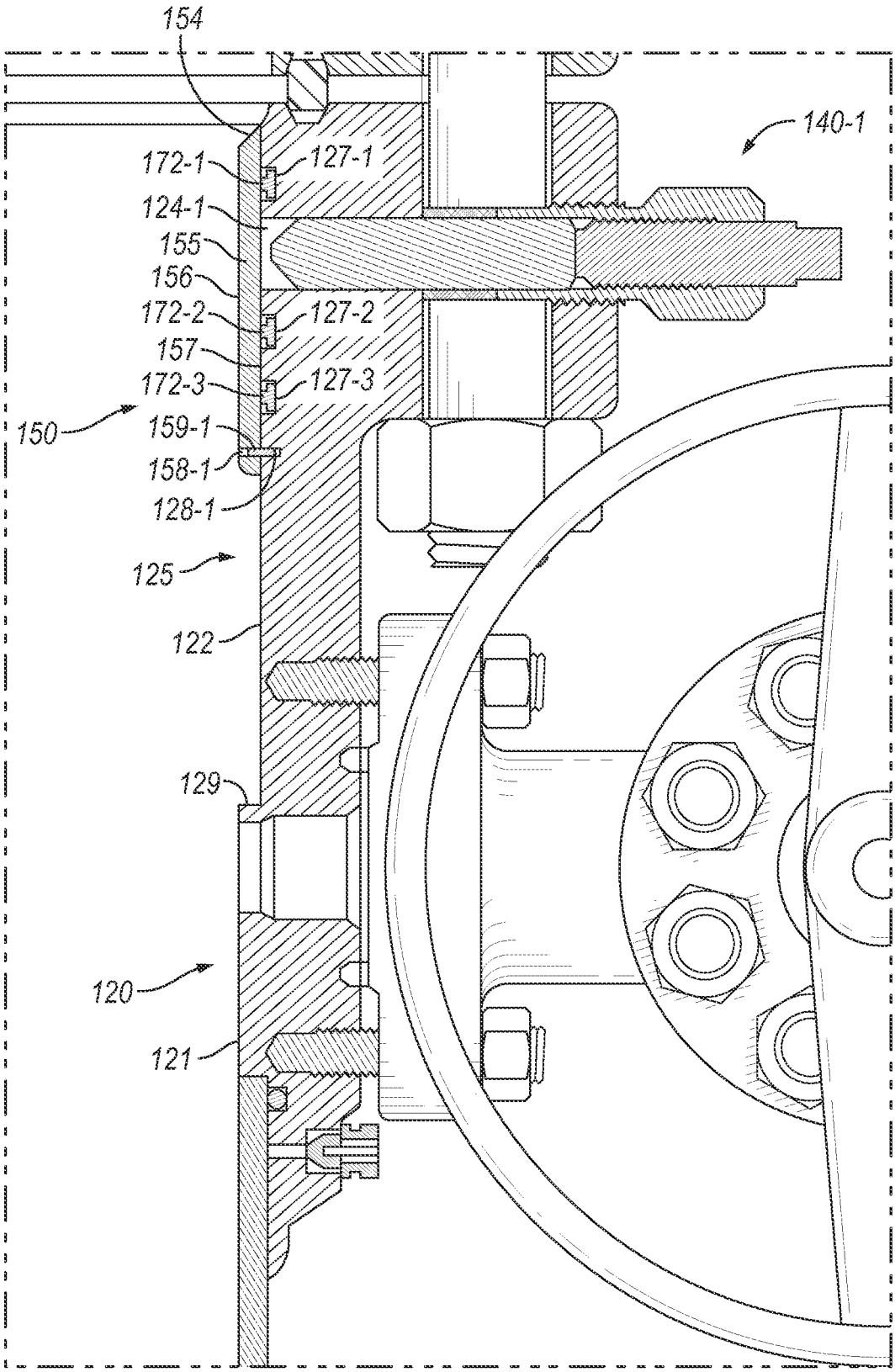

FIGS. 1A through 1C show a portion of a wellhead assembly 100 according to certain example embodiments. Specifically, FIG. 1A shows a sectional view of the portion of a wellhead assembly 100. FIG. 1B shows a detailed sectional view of the wellhead assembly 100. FIG. 1C shows another detailed sectional view of the wellhead assembly 100. The wellhead assembly 100 includes multiple components. In this case, the wellhead assembly 100 includes multiple valves 112 (e.g., valve 112-1, valve 112-2), multiple gauges 114 (e.g., gauge 114-1, gauge 114-2), one or more (in this case, 2) lockdown screws 140 (e.g., lockdown screw 140-1 and lockdown screw 140-2), a spool 120, and an example sleeve 150. When these components are coupled to each other, a cylindrical cavity 105 is continuously formed through the wellhead assembly 100.

The components shown in FIG. 1 are not exhaustive, and in some embodiments, one or more of the components shown in FIG. 1 may not be included in a wellhead assembly in which the example sleeve 150 can be used. Any component of the wellhead assembly 100 can be discrete or combined with one or more other components of the wellhead assembly 100. Also, one or more components of the wellhead assembly 100 can have different configurations.

The spool 120 in this case is a casing spool. The spool 120 has an inner wall 122 that forms part of the substantially cylindrical cavity 105 along its height. The spool 120 also has one or more horizontal apertures 124 that traverse some or all of the width of the spool 120. In this case, there are two apertures 124 that traverse the entire thickness of the spool 120. Aperture 124-1 is disposed on one side of the spool 120, and the other aperture 124-2 is disposed on the opposite side of the spool 120. Each aperture 124 is configured to have a lockdown screw 140 disposed therein. In this case, the lockdown screw 140-1 is disposed in the aperture 124-1, and the lockdown screw 140-2 is disposed in the aperture 124-2.

In certain example embodiments, the inner wall 121 can be modified to accommodate the sleeve 150. For example, in this case, the inner wall 121 has a recess 125 disposed therein. The purpose of the recess 125 is to allow the sleeve 150 to move vertically within the recess 125 so that the sleeve 150 covers the proximal end (the end exposed to the cavity 105) of the apertures 124 when the sleeve 150 is in a first position (e.g., a top portion) within the recess 125 and so that the sleeve 150 leaves the proximal end of the apertures 124 exposed to the cavity 105 when the sleeve 150 is in a second position (e.g., a bottom portion) within the recess 125.

The characteristics (e.g., height, depth, location along the inner wall 121) of the recess 125 can vary based on one or more of a number of factors, including but not limited to the characteristics (e.g., height, thickness) of the sleeve 150, the location of the apertures 124, and the location of other features (e.g., test ports) of the spool 120. In this case, the recess 125 has a height that is approximately twice the height of the sleeve 150, a depth that is substantially equal to the thickness of the sleeve 150, and a concave curvature that is substantially the same as the concave curvature of the sleeve 150. Also, the recess 125 is vertically disposed starting at the top of the spool 120. The recess 125 has a back wall 122 and a bottom wall 129, which acts as a stop to limit the downward travel of the sleeve 150 within the recess 125.

The back wall 122 of the recess 125 can include one or more features to accommodate the sleeve 150 and enhance the performance of the sleeve 150. For example, the back wall 122 of the recess 125 can have one or more apertures 128 disposed therein. In such a case, each aperture 128 can be configured to receive a shear pin 159 that extends outward from the outer surface 157 of the sleeve 150. For example, a shear pin 159 can be inserted into an aperture 158 that traverses the body 155 of the sleeve as well as being disposed in an aperture 128 in the back wall 122 of the recess 125. Alternatively, a shear pin 159 can be integrated with the sleeve 150.

In this example, there are two such apertures 128 in the back wall 122 of the recess 125, where aperture 128-1 receives shear pin 159-1, and aperture 128-2 receives shear pin 159-2. Similarly, the body 155 of the sleeve 150 has two apertures 158 that traverse therethrough toward the bottom of the body 155, where aperture 158-1 receives shear pin 159-1, and aperture 158-2 receives shear pin 159-2. Each shear pin 159, when disposed in an aperture 128 and an aperture 158, is configured to act as a resistive element that keeps the sleeve 150 positioned at a top portion of the recess 125 to cover the apertures 124 in the spool 120 until a sufficiently strong downward force is applied to the sleeve 150 to push the sleeve 150 to the bottom portion of the recess 125. The location of each aperture 128 along the height of the recess 125 is designed to coincide with the location of an aperture 158 when the sleeve 150 is in position to cover the apertures 124 and engage the sealing members 172, as discussed below. In some alternative embodiments, the shear pins 159, the apertures 158, and the apertures 128 are absent from the wellhead assembly 100.

As another example of a feature in the back wall 122 of the recess 125 to accommodate the sleeve 150, the back wall 122 can have one or more channels 127 disposed therein. Each such channel 127 can be used to receive a sealing member 172. In this case, there are three channels 127 disposed horizontally in the back wall 122 of the recess 125. Channel 127-1 is located close to the top of the spool 120 above the aperture 124-1, and the channel 127-1 receives sealing member 172-1. Channel 127-2 is located just below the aperture 124-1, and the channel 127-2 receives sealing member 172-2. Channel 127-3 is located just below the channel 127-2, and the channel 127-3 receives sealing member 172-3.

When a sealing member 172 abuts against one or more surfaces (in this case, the channel 127 in which the sealing member 172 is disposed and the outer surface 157 of the body 155 of the sleeve 150), the sealing member 172 is configured to serve as a barrier to prevent solids and fluids from passing from one side of the sealing member 172 to the other side of the sealing member 172. A sealing member 172 can also serve to maintain a pressure differential between opposing side of the sealing member 172. Each sealing member 172 can be made of any suitable material (e.g., rubber, nylon, metal) to serve its purpose as a barrier. Examples of a sealing member 172 can include, but are not limited to, an O-ring, a gasket, a washer, and silicone. In some cases, the sealing members 172 can act, either on their own or in conjunction with another component (e.g., the shear pins 159), as a resistive element to help keep the sleeve 150 positioned over the apertures 124 in the spool 120 until a sufficiently strong downward force is applied to the sleeve 150 to push the sleeve 150 to the bottom portion of the recess 125.

The example sleeve 150 is configured to be movably disposed within the recess 125. During initial stages (e.g., stimulation, fracturing, early workover procedures) of a subterranean field operation, the sleeve 150 is positioned at the top portion of the recess 125, as shown in FIGS. 1A through 1C, so that the sleeve 150 covers the apertures 124 inside of which the lockdown screws 140 are disposed. In this position within the recess 125, the sleeve 150 protects (isolates) the lockdown screws 140 from debris, high pressure, and other elements that can damage the lockdown screws 140 before they are deployed for use during subsequent stages of the subterranean field operation.

The sleeve 150 has a body 155 that has an inner surface 156 and an outer surface 157. The inner surface 156 of the body 155 forms a boundary for the cavity 105, and the outer surface 157 abuts against the back wall 122 of the recess 125 and/or the sealing members 172 disposed in the channels 127 disposed in the back wall 122 of the recess 125. In alternative embodiments, when the thickness of the body 155 of the sleeve 150 is sufficiently large, the outer surface 157 can have one or more channels (similar to the channels 127 in the back wall 122) disposed therein to receive one or more sealing members (similar to sealing members 172).

The sleeve 150 can have one or more characteristics (e.g., convex curvature, height, thickness, material) that ensure that the sleeve 150 protects (isolates from the environmental conditions in the cavity 105) the lockdown screws 140 when the sleeve 150 covers the apertures 124. For example, the height of the body 155 of the sleeve 150 is sufficiently large to cover the apertures 124 and also simultaneously engage the sealing members 172. As another example, the body 155 of the sleeve 150 is made of stainless steel or some other material that will not deteriorate or become deformed when exposed to high pressures, high temperatures, high vibrations, and various solids and fluids traveling at high velocities, any of which can occur during the various stages of a subterranean field operation.

In certain example embodiments, the sleeve 150 can be configured to allow for engagement with another component of the wellhead assembly 100. For example, as shown in FIGS. 1A through 1C, the top end of the body 155 of the sleeve 150 can be chamfered to create a slanted top surface 154. As shown below in FIGS. 2 through 3B, this slanted top surface 154 is configured to complement a slanted (chamfered) bottom surface 134 of a hanger 130, which enhances the engagement of those features when the hanger 130 abuts against the sleeve 150.

As discussed above, the sleeve 150 can also include one or more resistive elements. For example, in this case, the sleeve 150 has two shear pins 159 (shear pin 159-1 and shear pin 159-2) that traverse two apertures 158 (aperture 158-1 and aperture 158-2) that traverse the body 155 of the sleeve 150 toward the bottom of the sleeve 150. The shear pins 159 are also configured to be disposed inside the apertures 128 in the back wall 122 of the recess 125 during initial stages of a subterranean field operation. Specifically, shear pin 159-1 is disposed within aperture 158-1 and aperture 128-1, and shear pin 159-2 is disposed within aperture 158-2 and aperture 128-2.

Figure 2:
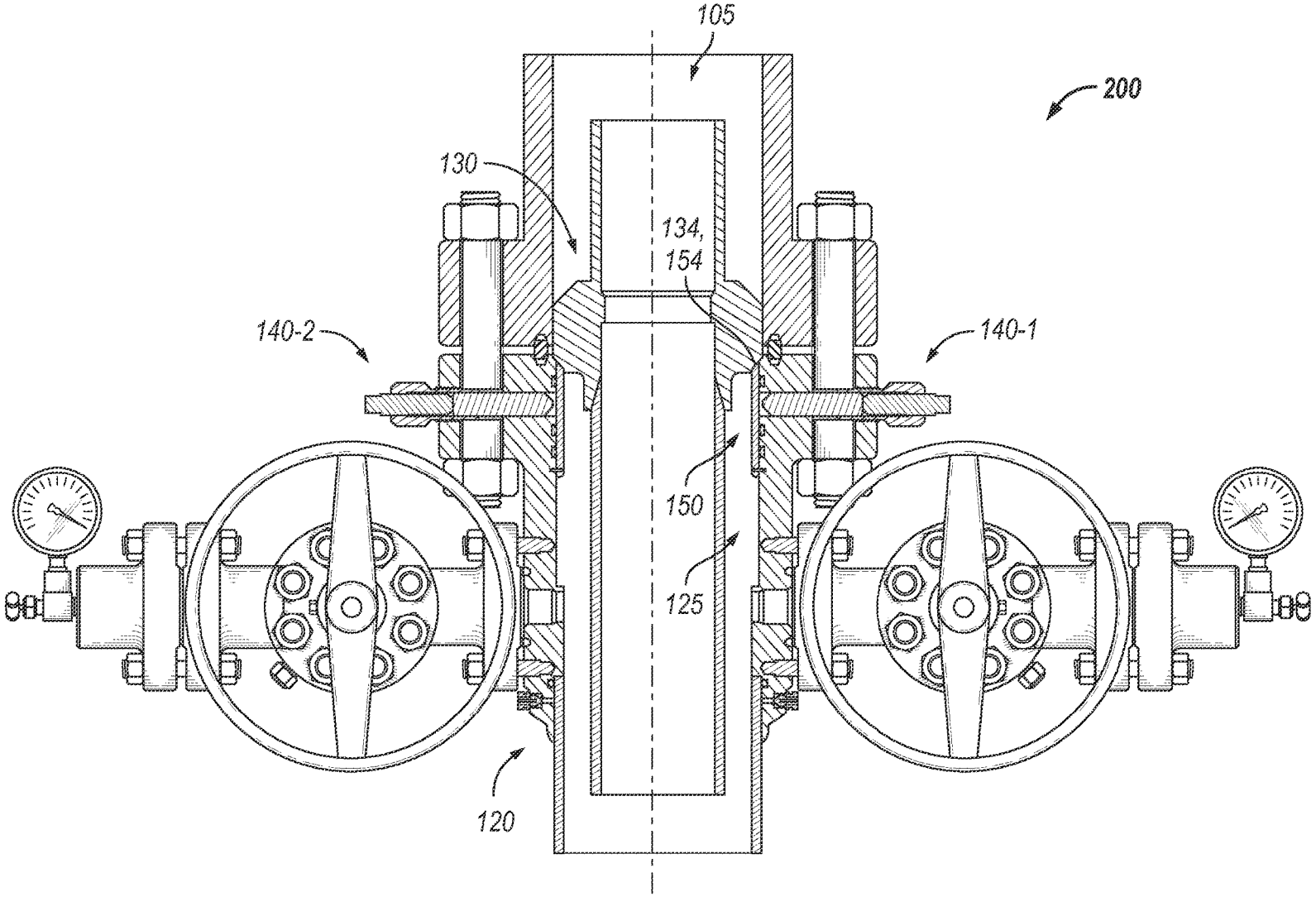
FIG. 2 shows a revised wellhead assembly that includes the wellhead assembly of FIGS. 1A through 1C with the addition of a hanger.

FIG. 2 shows a revised wellhead assembly 200 that includes the wellhead assembly 100 of FIGS. 1A through 1C with the addition of a hanger 130. Referring to FIGS. 1A through 2, the wellhead assembly 200 of FIG. 2 shows a point in time when the hanger 130 is tripped into the wellbore just as the hanger 130 makes contact with (abuts against) the sleeve 150. The hanger 130 in this case is a casing hanger. As discussed above, the hanger 130 has a chamfered bottom surface 134 that substantially completely abuts against the slanted (chamfered) top surface 154 of the sleeve 150. At the point in time shown in FIG. 2, the hanger 130 is not exerting sufficient force to overcome the resistive elements of the sleeve 150. Put another way, the shear pines 159 remain whole at the time captured in FIG. 2, and to the extent that the friction created by the sealing members 172 against the outer surface 157 of the body 155 of the sleeve 150 also acts as a resistive element, the friction helps to hold the sleeve 150 in place. As a result, the sleeve 150 remains positioned at the top portion of the recess 125, thereby keeping the apertures 124 in the spool 120 covered and the lockdown screws 140 protected (isolated) from elements within the cavity 105.

Figure 3A:
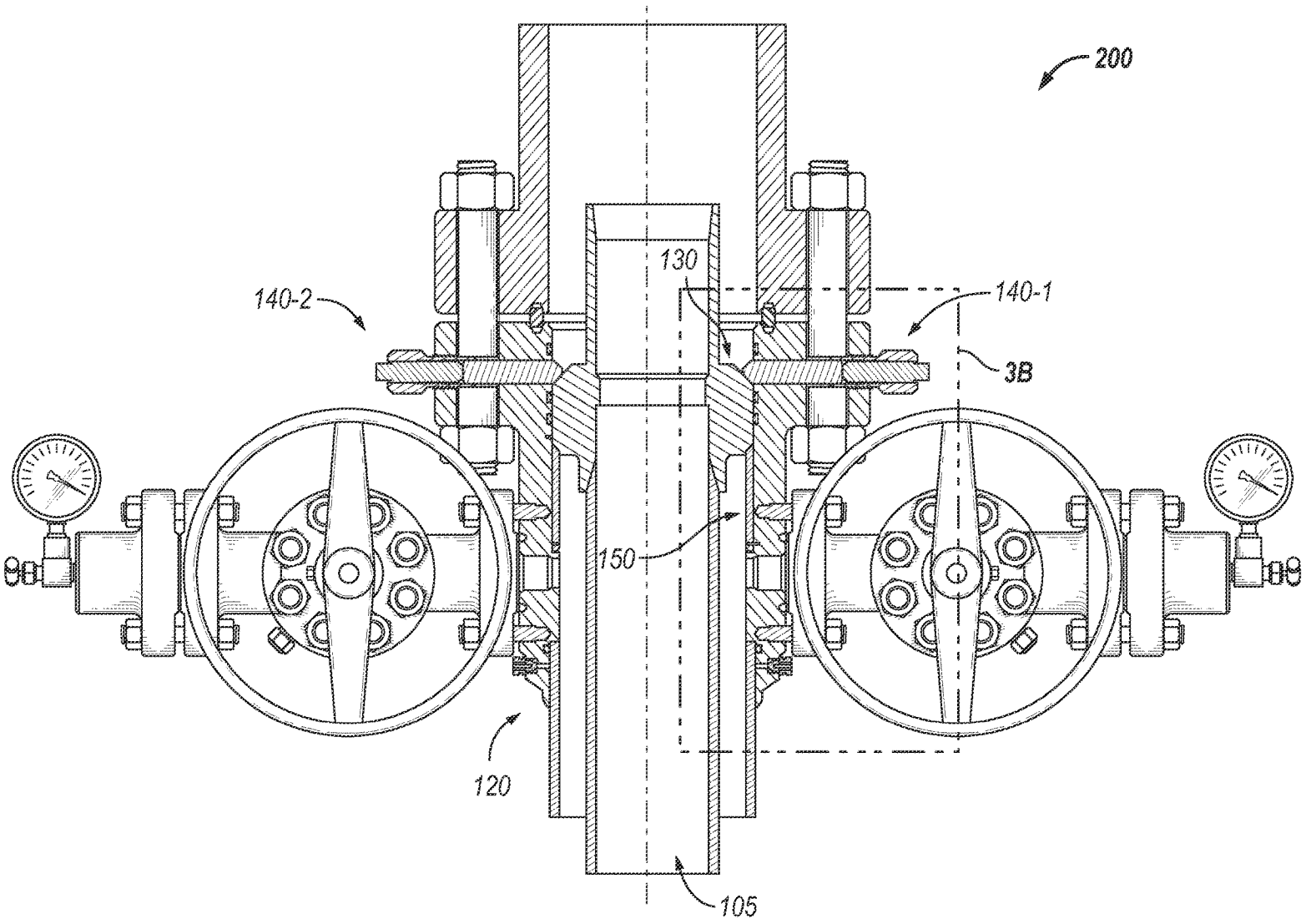
FIGS. 3A and 3B show the wellhead assembly of FIG. 2 with the lockdown screws engaged.
Figure 3B:
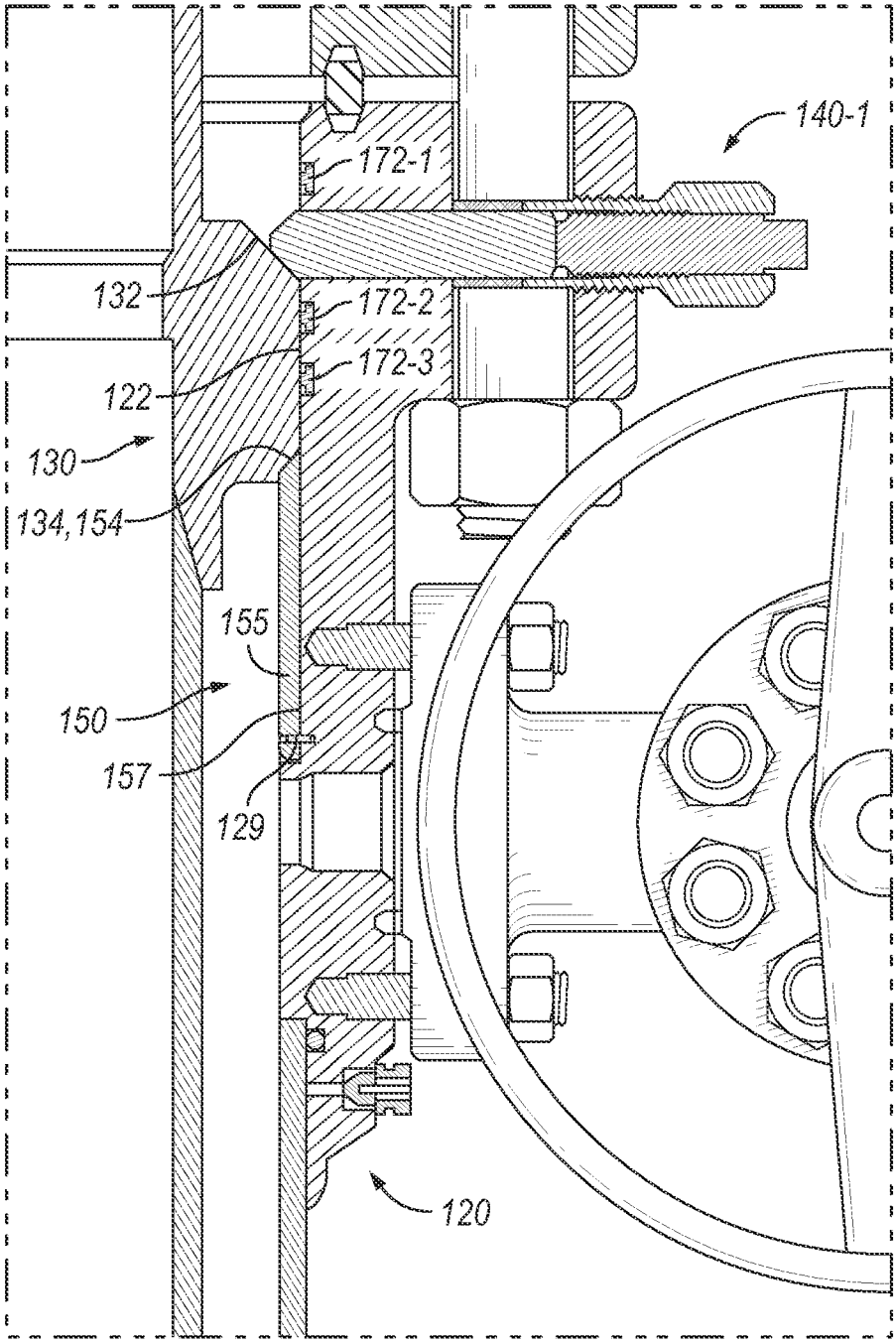

FIGS. 3A and 3B show the wellhead assembly 200 of FIG. 2 with the lockdown screws 140 engaged. Specifically, FIG. 3A shows a sectional view of the wellhead assembly 200, and FIG. 3B shows a detailed view of part of the wellhead assembly 200. Referring to FIGS. 1A through 3B, FIGS. 3A and 3B capture the wellhead assembly 200 at a point in time (e.g., 10 seconds, 10 minutes, 4 hours) after the point in time of the wellhead assembly 200 captured in FIG. 2. At the point in time captured in FIGS. 3A and 3B, the hanger 130 is tripped further into the cavity 105. To allow for this to happen, the hanger 130 has sufficient force to overcome the resistive elements of the sleeve 150. As a result, the shear pines 159 break, and any frictional resistance offered by the sealing members 172 against the outer surface 157 of the sleeve 150 is not strong enough to keep the sleeve 150 in place at the top portion of the recess 125.

Consequently, as shown in FIGS. 3A and 3B, the sleeve 150 is moved downward to the bottom portion of the recess 125. Specifically, the bottom of the sleeve 150 abuts against the bottom wall 129 of the recess 125, acting as a stop against further downward movement of the sleeve 150. Also, when the sleeve 150 abuts against the bottom wall 129 of the recess 125, the sleeve 150 stops the downward movement of the hanger 130 within the cavity 105.

To keep the hanger 130 in this position within the cavity 105, the lockdown screws 140, no longer covered by the sleeve 150, extend out of the apertures 124 and into the cavity 105. When this occurs, the lockdown screws 140 abut against a top surface of the hanger 130. In this case, the head of each lockdown screw 140 is chamfered, which complements the chamfered top surface 134 of the hanger 130. When the head of each lockdown screw 140 abuts against the chamfered top surface 134 of the hanger 130, the hanger 130 is prevented from moving upward within the cavity 105.

Also, since the diameter of the hanger 130 is substantially the same as the diameter of the back wall 122 of the recess 120, the hanger 130 can abut against one or more of the sealing members 172. In this case, as shown in FIGS. 3A and 3B, when the hanger 130 is retained by the lockdown screws 140 and the sleeve 150, the hanger 130 abuts against sealing member 172-2 and sealing member 172-3, providing continued isolation and protection for the lockdown screws 140 from elements downhole of the hanger 130 within the cavity 105. Sealing member 172-1 is no longer engaged at the point in time shown in FIGS. 3A and 3B, and so the lockdown screws 140 can be exposed to elements above the hanger 130 within the cavity 105.

Figure 4A:
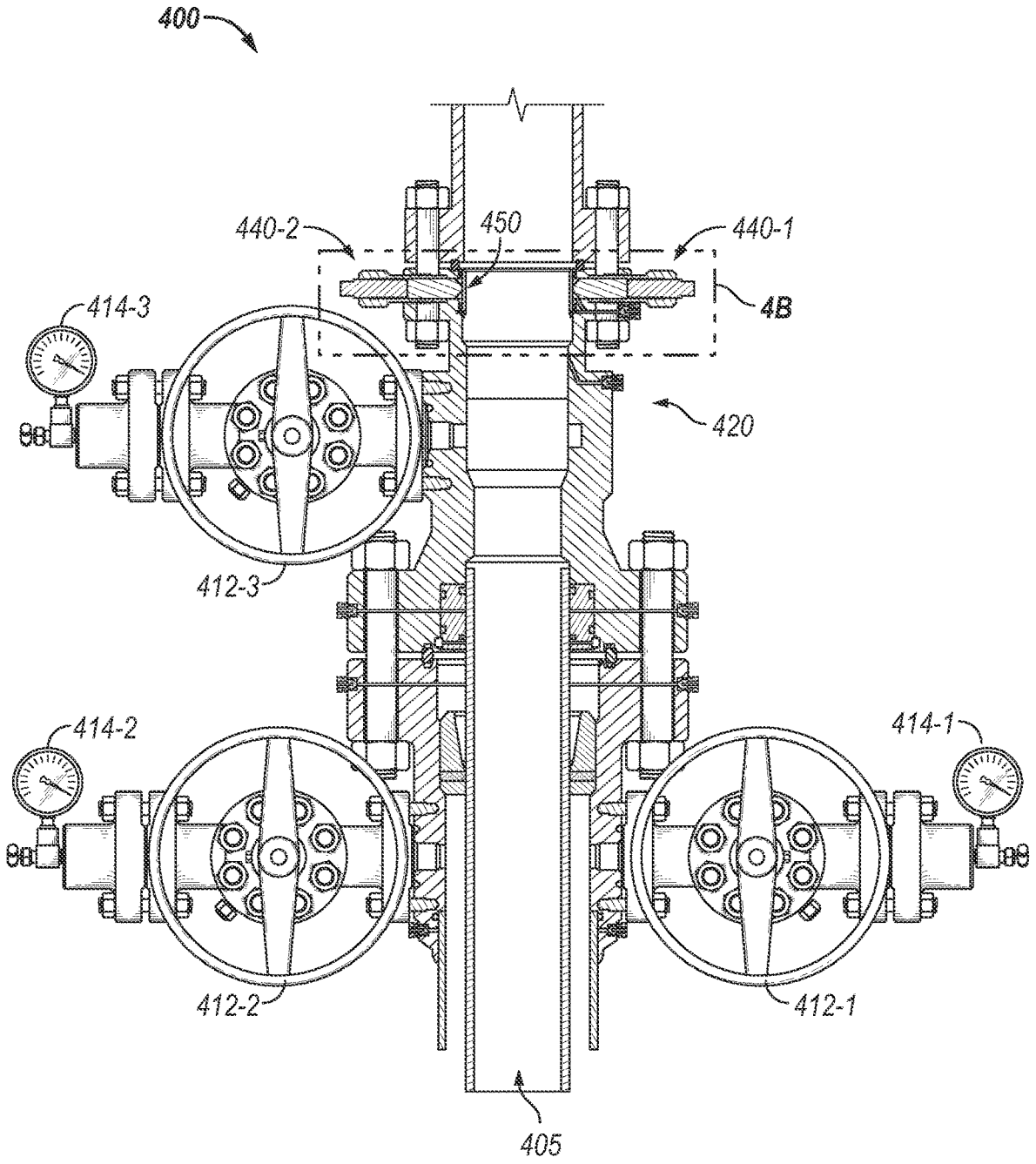
FIGS. 4A and 4B show a sectional view of a portion of another wellhead assembly according to certain example embodiments.
Figure 4B:
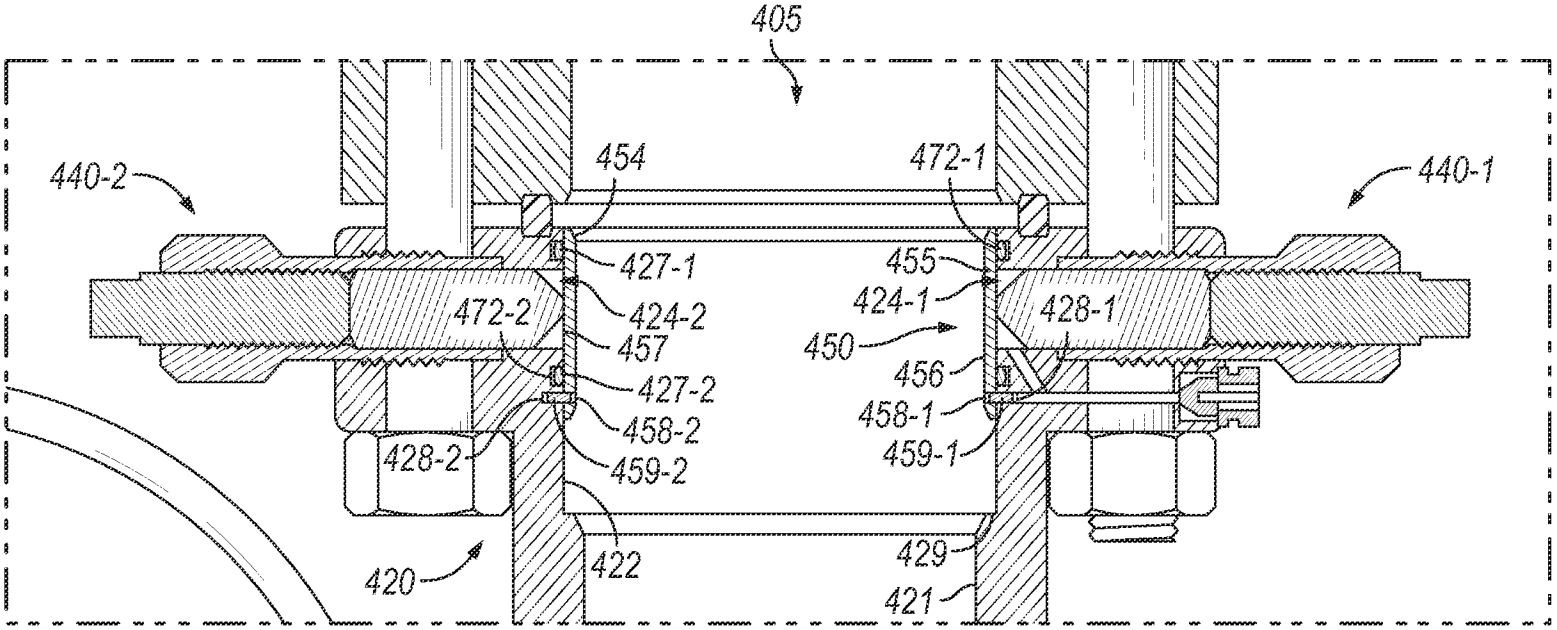

FIGS. 4A and 4B show a sectional view of a portion of another wellhead assembly 400 according to certain example embodiments. Specifically, FIG. 4A shows a sectional view of the wellhead assembly 400, and FIG. 4B shows a detailed view of part of the wellhead assembly 400. Referring to FIGS. 1A through 4B, the wellhead assembly 400 of FIGS. 4A and 4B includes multiple valves 412 (e.g., valve 412-1, valve 412-2, valve 412-3), multiple gauges 414 (e.g., gauge 414-1, gauge 414-2, gauge 414-3), one or more (in this case, 2) lockdown screws 440 (e.g., lockdown screw 440-1 and lockdown screw 440-2), a spool 420, and an example sleeve 450. When these components are coupled to each other, a cylindrical cavity 405 is continuously formed through the wellhead assembly 400.

The various components (e.g., valves 412, lockdown screws 440, spool 420, sleeve 450, sealing members 472) of the wellhead assembly 400 of FIGS. 4A and 4B are substantially the same as the corresponding components of the wellhead assembly 100 of FIGS. 1A through 1C, except as discussed below. Therefore, the description of a component of the wellhead assembly 100 listed above can apply to the corresponding component of the wellhead assembly 400 of FIGS. 4A and 4B.

The spool 420 in this case is a tubing spool. The spool 420 has an inner wall 422 that forms part of the substantially cylindrical cavity 405 along its height. The spool 420 also has one or more horizontal apertures 424 that traverse some or all of the width of the spool 420. In this case, there are two apertures 424 that traverse the entire thickness of the spool 420. Aperture 424-1 is disposed on one side of the spool 420, and the other aperture 424-2 is disposed on the opposite side of the spool 420. Each aperture 424 is configured to have a lockdown screw 440 disposed therein. In this case, the lockdown screw 440-1 is disposed in the aperture 424-1, and the lockdown screw 440-2 is disposed in the aperture 424-2.

As with the spool 120 above, the inner wall 421 of the spool 420 is modified to accommodate the sleeve 450. In this case, the inner wall 421 has a recess 425 disposed therein. The purpose of the recess 425 is to allow the sleeve 450 to move vertically within the recess 425 so that the sleeve 450 covers the proximal end (the end exposed to the cavity 405) of the apertures 424 when the sleeve 450 is in a first position (e.g., a top portion) within the recess 425 and so that the sleeve 450 leaves the proximal end of the apertures 424 exposed to the cavity 405 when the sleeve 450 is in a second position (e.g., a bottom portion) within the recess 425.

The recess 425 has a height that is a bit less than twice the height of the sleeve 450, a depth that is substantially equal to the thickness of the sleeve 450, and a concave curvature that is substantially the same as the concave curvature of the sleeve 450. Also, the recess 425 is vertically disposed starting at the top of the spool 420. The recess 425 has a back wall 422 and a bottom wall 429, which acts as a stop to limit the downward travel of the sleeve 450 within the recess 425.

The back wall 422 of the recess 425 can include one or more features to accommodate the sleeve 450 and enhance the performance of the sleeve 450. For example, in this case, there are two horizontal apertures 428 in the back wall 422 of the recess 425, where aperture 428-1 receives shear pin 429-1 of the sleeve 450, and aperture 428-2 receives shear pin 429-2 of the sleeve 450. Similarly, the body 455 of the sleeve 450 has two apertures 458 that traverse therethrough toward the bottom of the body 455, where aperture 458-1 receives shear pin 459-1, and aperture 458-2 receives shear pin 459-2.

Each shear pin 459, when disposed in an aperture 428 and an aperture 458, is configured to act as a resistive element that keeps the sleeve 450 positioned at the top portion of the recess 425 to cover the apertures 424 in the spool 420 until a sufficiently strong downward force is applied to the sleeve 450 to push the sleeve 450 to the bottom portion of the recess 425. The location of each aperture 428 along the height of the recess 425 is designed to coincide with the location of an aperture 458 in the body 455 of the sleeve 450 when the sleeve 450 is in position to cover the apertures 424 and engage the sealing members 472, as discussed below. In this case, the distal ends of the lockdown screws 440 abut against the outer surface 457 of the body 455 of the sleeve 450 when the sleeve 450 is located at the top portion of the recess 425.

As another example of a feature in the back wall 422 of the recess 425 to accommodate the sleeve 450, the back wall 422 has two channels 427 disposed horizontally therein, where each channel 427 receives a sealing member 472. Channel 427-1 is located close to the top of the spool 420 above the aperture 424-1, and the channel 427-1 receives sealing member 472-1. Channel 427-2 is located just below the aperture 424-1, and the channel 427-2 receives sealing member 472-2.

When a sealing member 472 abuts against one or more surfaces (in this case, the channel 427 in which the sealing member 472 is disposed and the outer surface 457 of the body 455 of the sleeve 450), the sealing member 472 is configured to serve as a barrier to prevent solids and fluids from passing from one side of the sealing member 472 to the other side of the sealing member 472. A sealing member 472 can also serve to maintain a pressure differential between opposing side of the sealing member 472. In some cases, the sealing members 472 can act, either on their own or in conjunction with another component (e.g., the shear pins 459), as a resistive element to help keep the sleeve 450 positioned over the apertures 424 in the spool 420 until a sufficiently strong downward force is applied to the sleeve 450 to push the sleeve 450 to the bottom portion of the recess 425.

The example sleeve 450 is configured to be movably disposed within the recess 425. During initial stages (e.g., stimulation, fracturing, early workover procedures) of a subterranean field operation, the sleeve 450 is positioned at the top portion of the recess 425, as shown in FIGS. 4A and 4B, so that the sleeve 450 covers the apertures 424 inside of which the lockdown screws 440 are disposed. In this position within the recess 425, the sleeve 450 protects (isolates) the lockdown screws 440 from debris, high pressure, and other elements that can damage the lockdown screws 440 before they are deployed for use during subsequent stages of the subterranean field operation.

The sleeve 450 has a body 455 that has an inner surface 456 and an outer surface 457. The inner surface 456 of the body 455 forms a boundary for the cavity 405, and the outer surface 457 abuts against the back wall 422 of the recess 425 and/or the sealing members 472 disposed in the channels 427 disposed in the back wall 422 of the recess 425. In alternative embodiments, when the thickness of the body 455 of the sleeve 450 is sufficiently large, the outer surface 457 can have one or more channels (similar to the channels 427 in the back wall 422) disposed therein to receive one or more sealing members (similar to sealing members 472).

The sleeve 450 can have one or more characteristics (e.g., convex curvature, height, thickness, material) that ensure that the sleeve 450 protects (isolates) the lockdown screws 440 when the sleeve 450 covers the apertures 424. For example, the height of the body 455 of the sleeve 450 is sufficiently large to cover the apertures 424 and also simultaneously engage the sealing members 472. As another example, the body 455 of the sleeve 450 is made of stainless steel or some other material that will not deteriorate or become deformed when exposed to high pressures, high temperatures, high vibrations, and various solids and fluids traveling at high velocities, any of which can occur during the various stages of a subterranean field operation.

In certain example embodiments, the sleeve 450 can be configured to allow for engagement with another component of the wellhead assembly 400. For example, as shown in FIGS. 4A and 4B, the top end of the body 455 of the sleeve 450 can be chamfered to create a slanted top surface 454. As shown below in FIGS. 5A through 6B, this slanted top surface 454 is configured to complement a slanted (chamfered) bottom surface 434 of a hanger 430, which enhances the engagement of those features when the hanger 430 abuts against the sleeve 450.

As discussed above, the sleeve 450 can also include one or more resistive elements. For example, in this case, the sleeve 450 has two shear pins 459 (shear pin 459-1 and shear pin 459-2) that traverse two apertures 458 (aperture 458-1 and aperture 458-2) that traverse the body 455 of the sleeve 450 toward the bottom of the sleeve 450. The shear pins 459 are also configured to be disposed inside the apertures 428 in the back wall 422 of the recess 425 during initial stages of a subterranean field operation. Specifically, shear pin 459-1 is disposed within aperture 458-1 and aperture 428-1, and shear pin 459-2 is disposed within aperture 458-2 and aperture 428-2.

Figure 5A:
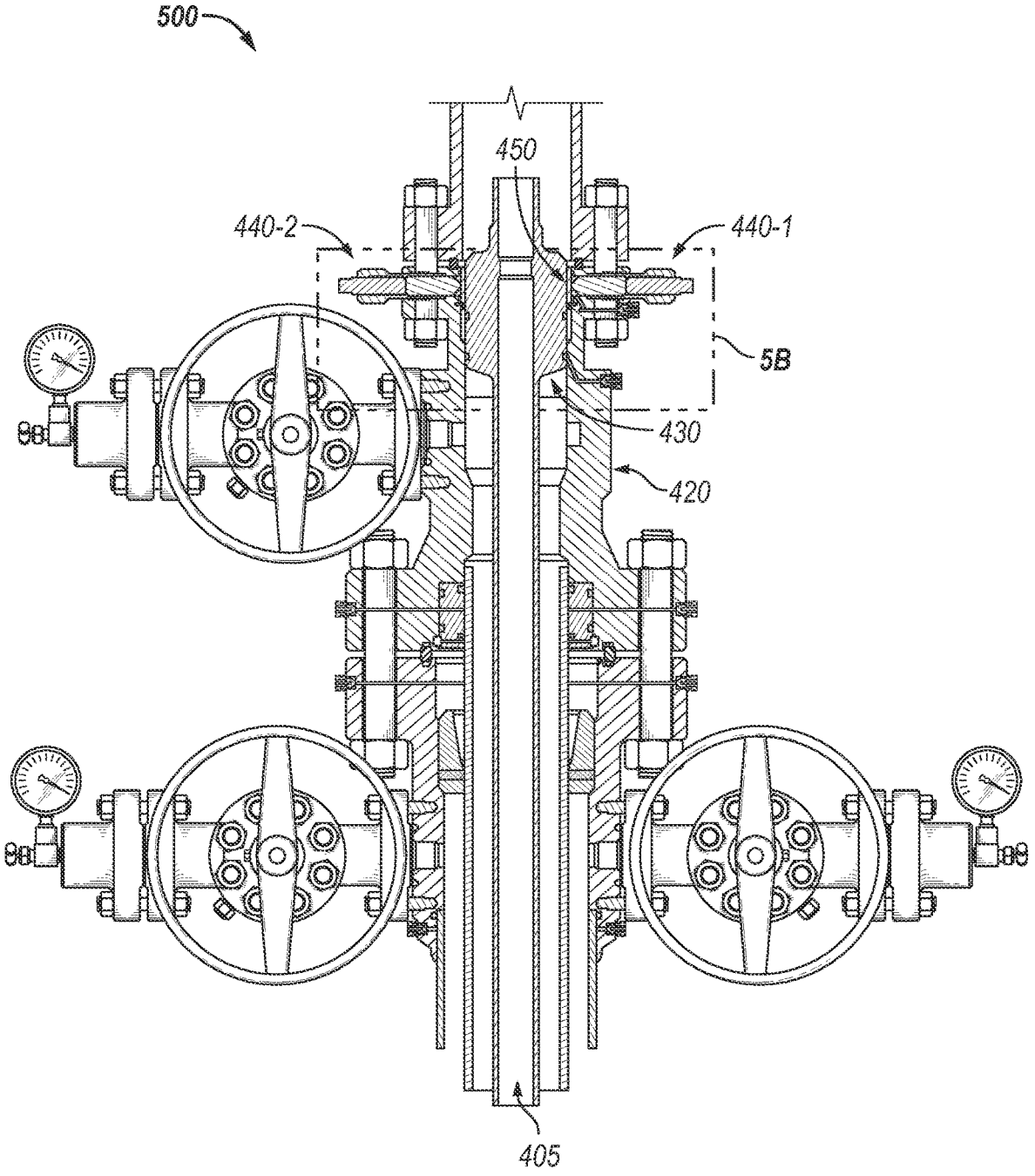
FIGS. 5A and 5B show a revised wellhead assembly 200 that includes the wellhead assembly of FIGS. 4A and 4B with the addition of a hanger.
Figure 5B:
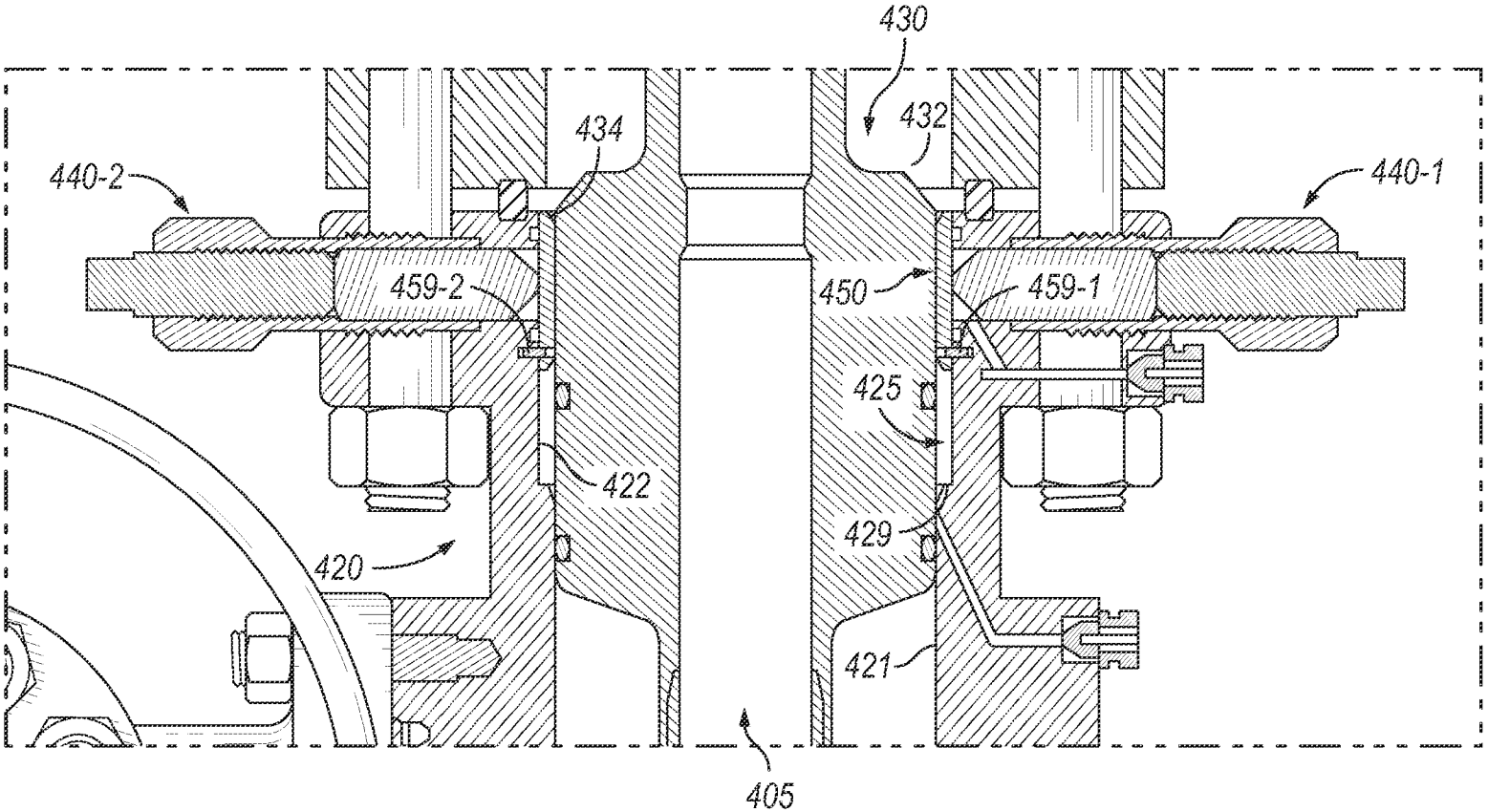

FIGS. 5A and 5B show a revised wellhead assembly 500 that includes the wellhead assembly 400 of FIGS. 4A and 4B with the addition of a hanger 430. Specifically, FIG. 5A shows a sectional view of the wellhead assembly 500, and FIG. 5B shows a detailed view of part of the wellhead assembly 500. Referring to FIGS. 1A through 5B, the wellhead assembly 500 of FIGS. 5A and 5B shows a point in time when the hanger 430 is tripped into the wellbore just as the hanger 430 makes contact with (abuts against) the sleeve 450. The hanger 430 in this case is a tubing hanger. As discussed above, the hanger 430 has a chamfered bottom surface 434 that substantially completely abuts against the slanted (chamfered) top surface 454 of the sleeve 450. At the point in time shown in FIGS. 5A and 5B, the hanger 430 is not exerting sufficient force to overcome the resistive elements of the sleeve 450. Put another way, the shear pines 459 remain whole at the time captured in FIGS. 5A and 5B, and to the extent that the friction created by the sealing members 472 against the outer surface 457 of the body 455 of the sleeve 450 also acts as a resistive element, the friction helps to hold the sleeve 450 in place. As a result, the sleeve 450 remains positioned at the top portion of the recess 425, thereby keeping the apertures 424 in the spool 420 covered and the lockdown screws 440 protected from elements within the cavity 405.

Figure 6A:
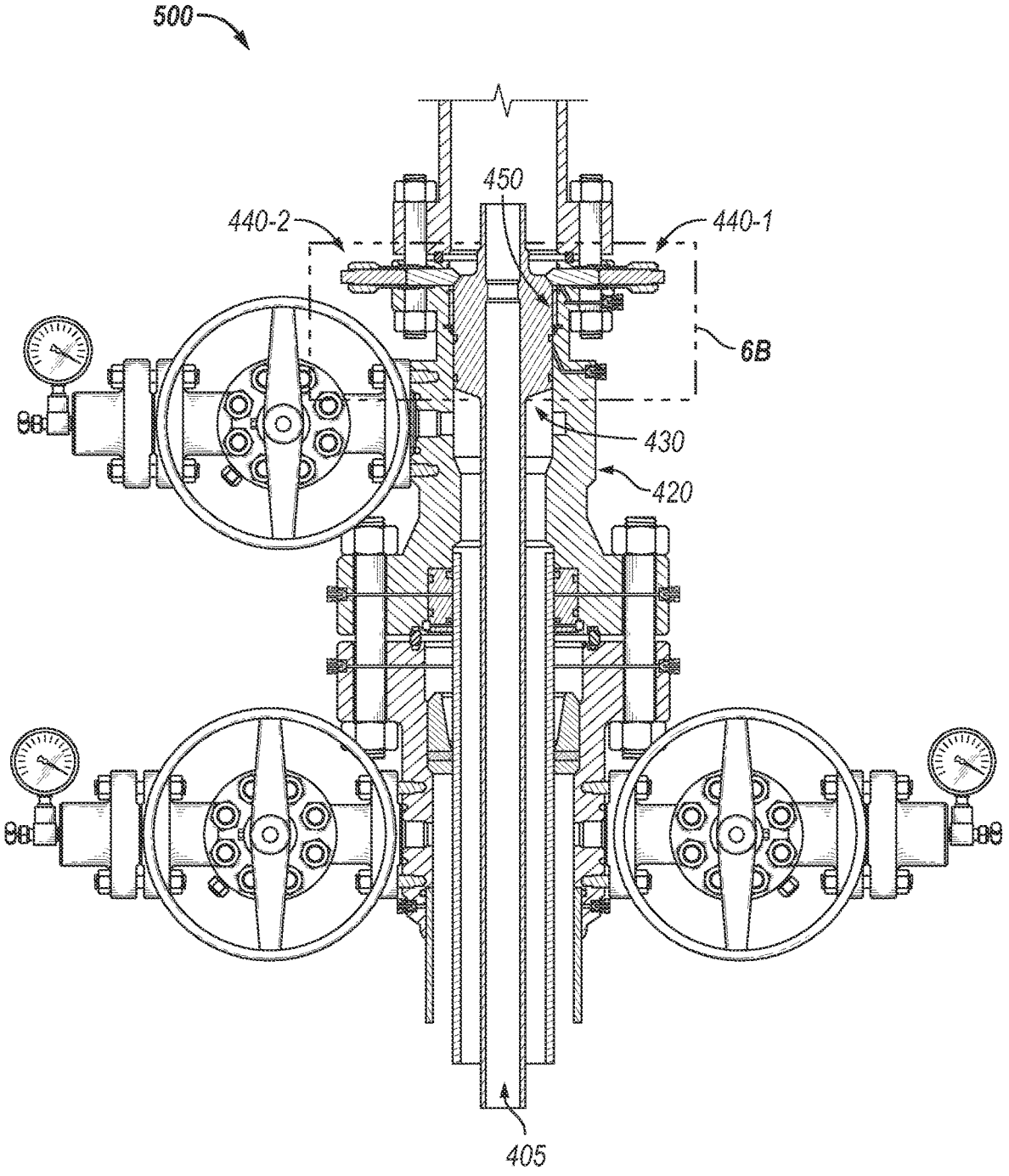
FIGS. 6A and 6B show the wellhead assembly of FIGS. 5A and 5B with the lockdown screws engaged.
Figure 6B:
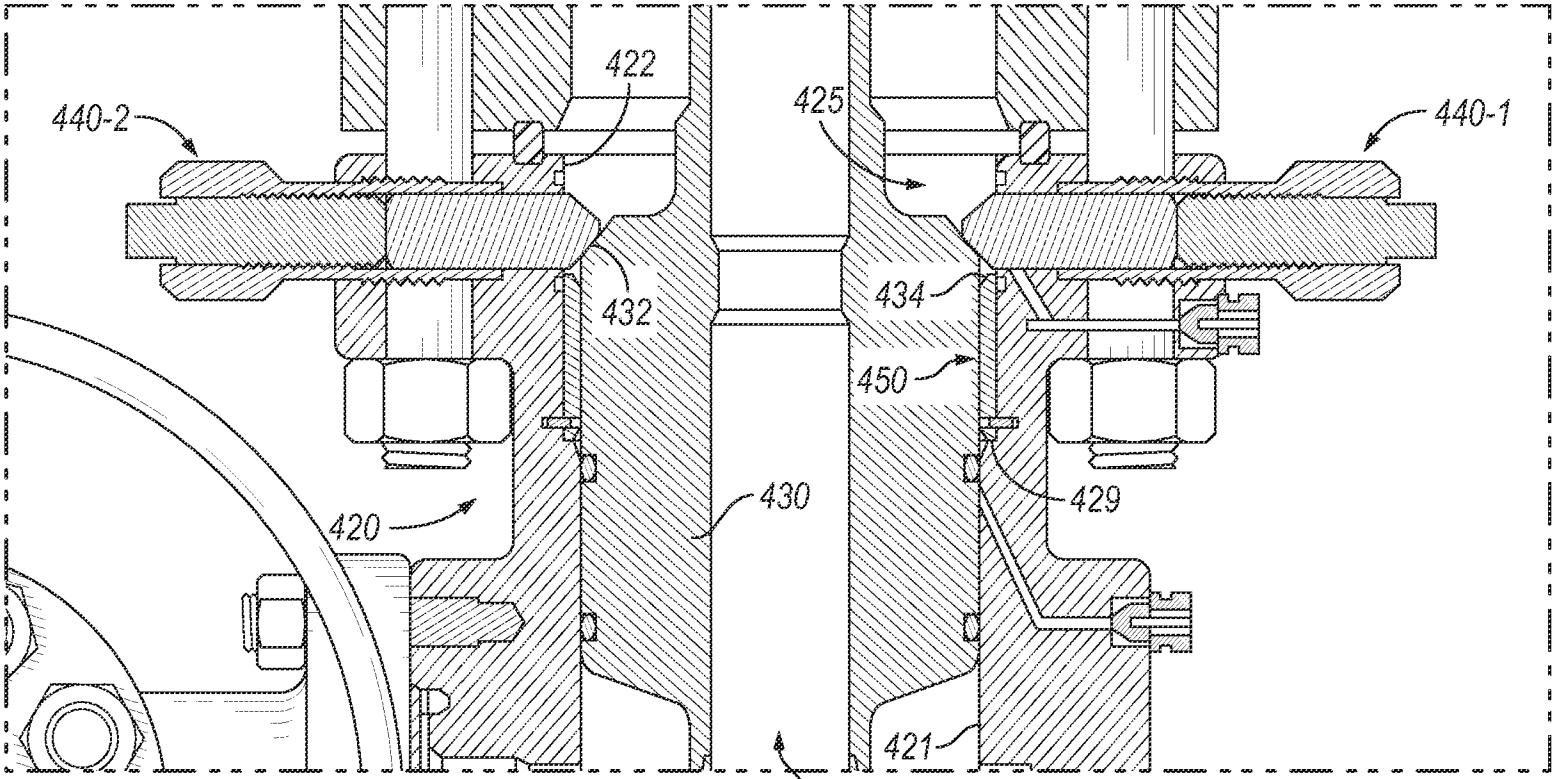

FIGS. 6A and 6B show the wellhead assembly 500 of FIGS. 5A and 5B with the lockdown screws 440 engaged. Specifically, FIG. 6A shows a sectional view of the wellhead assembly 500, and FIG. 6B shows a detailed view of part of the wellhead assembly 500. Referring to FIGS. 1A through 6B, FIGS. 6A and 6B capture the wellhead assembly 500 at a point in time (e.g., 10 seconds, 10 minutes, 4 hours) after the point in time of the wellhead assembly 500 captured in FIGS. 5A and 5B. At the point in time captured in FIGS. 6A and 6B, the hanger 430 is tripped further into the cavity 405. To allow for this to happen, the hanger 430 has sufficient force to overcome the resistive elements of the sleeve 450. As a result, the shear pines 459 break, and any frictional resistance offered by the sealing members 472 against the outer surface 457 of the sleeve 450 is not strong enough to keep the sleeve 450 in place at the top portion of the recess 425.

Consequently, as shown in FIGS. 6A and 6B, the sleeve 450 is moved downward to the bottom portion of the recess 425. Specifically, the bottom of the sleeve 450 abuts against the bottom wall 429 of the recess 425, acting as a stop against further downward movement of the sleeve 450. Also, when the sleeve 450 abuts against the bottom wall 429 of the recess 425, the sleeve 450 stops the downward movement of the hanger 430 within the cavity 405.

To keep the hanger 430 in this position within the cavity 405, the lockdown screws 440, no longer covered by the sleeve 450, extend out of the apertures 424 and into the cavity 405. When this occurs, the lockdown screws 440 abut against a top surface of the hanger 430. In this case, the head of each lockdown screw 440 is chamfered, which complements the chamfered top surface 434 of the hanger 430. When the head of each lockdown screw 440 abuts against the chamfered top surface 434 of the hanger 430, the hanger 430 is prevented from moving upward within the cavity 405.

Since the height of the body 455 of the sleeve 450 is more than half the length of the back wall 422 of the recess 425, the top of the sleeve 450 abuts against the sealing member 472-2 when the sleeve 450 is secured at the bottom portion of the recess 425, as when the hanger 430, retained by the lockdown screws 440, abuts against the top of the sleeve 450 and the bottom of the sleeve 450 abuts against the bottom wall 429 of the recess. As a result, the sealing member 172-2 provides continued isolation and protection for the lockdown screws 440 from elements downhole of the hanger 430 within the cavity 405. Sealing member 472-1 is no longer engaged at the point in time shown in FIGS. 6A and 6B, and so the lockdown screws 440 can be exposed to elements above the hanger 430 within the cavity 405.

Example embodiments can be used to isolate one or more lockdown screws within a wellhead assembly before the lockdown screws are engaged. Example embodiments can modify existing components (e.g., a spool) of the wellhead assembly while also adding one or more relatively small components (e.g., a sleeve, one or more shear pins, one or more sealing members) to the wellhead assembly. By protecting (isolating) the lockdown screws from high pressures, solids and fluids, vibrations, and other potentially harmful elements, the lockdown screws are less likely to be compromised when they become engaged, thereby greatly improving safety and reliability. Example embodiments can provide a number of benefits. Such other benefits can include, but are not limited to, ease of use, ease of manufacturing, flexibility, configurability, time savings, and compliance with applicable industry standards and regulations.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A sleeve for protecting a lockdown screw of a wellhead assembly, the sleeve comprising:

a body having an inner surface and an outer surface, wherein the body has a concave curvature, wherein the body is configured to be disposed within an upper portion of a recess of a component of the wellhead assembly prior to commencement of a field operation, wherein the body is configured to cover an aperture in an inner wall of the component, the aperture inside of which the lockdown screw is disposed when the body is disposed within the upper portion of the recess of the component, wherein the concave curvature of the body is configured to match that of the inner wall of the component, wherein the outer surface is configured to isolate the lockdown screw within the aperture from an environment in a cavity partially formed by the inner surface when the body is disposed in the upper portion of the recess prior to the commencement of the field operation, and wherein the body is further configured to move downward away from the upper portion of the recess during the commencement of the field operation to uncover the aperture.

2. The sleeve of claim 1, wherein a section of the outer surface of the body is configured to abut against a sealing member disposed in the inner wall of the component of the wellhead assembly prior to the commencement of the field operation.

3. The sleeve of claim 1, wherein a section of the outer surface of the body has a channel disposed therein, wherein the channel is configured to receive a sealing member prior to the commencement of the field operation.

4. The sleeve of claim 1, wherein the body forms a cylinder, and wherein the field operation comprises at least one of a group consisting of a stimulation operation, a fracturing operation, an early workover procedure, a shelf valve simulation operation, and a downhole screening operation.

5. The sleeve of claim 1, further comprising:

a shear pin that extends from a bottom end of the outer surface of the body, wherein the shear pin is configured to be disposed in the aperture in the inner wall of the component of the wellhead assembly prior to the commencement of the field operation, and wherein the shear pin is further configured to break when a minimal amount of downward force is applied to the body.

6. The sleeve of claim 5, wherein the body is configured to move to a lower portion of the recess when the shear pin breaks, wherein the shear pin is configured to break when a hanger is lowered atop the body within the recess of the component during commencement of the field operation, and wherein the outer surface of the body, when the body is in the lower portion of the recess, is no longer abutted by the lockdown screw.

7. The sleeve of claim 6, wherein the body has a chamfered top end that is configured to receive the hanger of the wellhead assembly during the commencement of the field operation.

8. A wellhead assembly comprising:

a spool having an inner wall with a recess that extends vertically along the inner wall, wherein the inner wall at the recess has a concave curvature, and wherein the spool has a horizontal aperture disposed in the inner wall toward an upper end of the recess and extending toward an outer wall of the spool;

a lockdown screw disposed within the horizontal aperture in the spool; and a sleeve movably disposed in the recess in the inner wall of the spool, wherein the sleeve comprises a body and a resistance element, wherein the body has an inner surface and an outer surface, wherein the body has the concave curvature, wherein the body is held in place in an upper portion of the recess of the spool by the resistance element prior to commencement of a field operation, wherein the lockdown screw abuts against the outer surface of the body when the sleeve is disposed in the upper portion of the recess prior to the commencement of the field operation, and wherein the sleeve is configured to move to a lower portion of the recess during the commencement of the field operation to release the lockdown screw.

9. The wellhead assembly of claim 8, further comprising:

a hanger that is configured to be movably disposed within the recess of the spool, wherein the hanger, when moved downward into the recess of the spool during the commencement of the field operation, abuts against a top end of the sleeve, wherein the hanger, when moved further downward into the recess of the spool, moves the sleeve to a bottom portion of the recess of the spool when the hanger applies a downward force sufficient to overcome the resistance element.

10. The wellhead assembly of claim 9, wherein the spool is a casing spool, and wherein the hanger is a casing hanger.

11. The wellhead assembly of claim 9, wherein the spool is a tubing spool, and wherein the hanger is a tubing hanger.

12. The wellhead assembly of claim 9, wherein the lockdown screw extends inward into a recessed area when the hanger moves the sleeve to the bottom portion of the recess.

13. The wellhead assembly of claim 12, wherein the lockdown screw abuts against a top surface of the hanger when the lockdown screw extends inward into the recessed area.

14. The wellhead assembly of claim 9, wherein the sleeve is limited in its downward travel within the recess by a bottom wall of the recess.

15. The wellhead assembly of claim 8, wherein the spool further has an additional horizontal aperture disposed in the inner wall toward an upper end of the recess and extending toward an outer wall of the spool, wherein the resistance element of the sleeve comprises a shear pin that extends from the body of the sleeve into the additional horizontal aperture disposed in the inner wall prior to the commencement of the field operation.

16. The wellhead assembly of claim 8, further comprising:

a plurality of sealing members disposed between the inner wall of the spool within the recess and the outer surface of the body of the sleeve prior to the commencement of the field operation, wherein one of the plurality of sealing members is disposed above the lockdown screw, and wherein another of the plurality of sealing members is disposed below the lockdown screw.

17. The wellhead assembly of claim 16, wherein the inner wall of the spool within the recess has a plurality of channels disposed therein, wherein the plurality of sealing members is disposed in the plurality of channels.

18. The wellhead assembly of claim 16, wherein the sleeve is moved to a bottom portion of the recess of the spool during the commencement of the field operation when a hanger applies a downward force to the sleeve that is sufficient to overcome the resistance element, and wherein the hanger abuts against the another of the plurality of sealing members disposed below the lockdown screw when the sleeve is disposed in the bottom portion of the recess.

19. A method for protecting a lockdown screw of a wellhead assembly, the method comprising:

installing the wellhead assembly at a wellbore, wherein the wellhead assembly comprises:

a spool having an inner wall with a recess that extends vertically along the inner wall, wherein the inner wall at the recess has a concave curvature, wherein the spool has a horizontal aperture disposed in the inner wall toward an upper end of the recess and extending toward an outer wall of the spool, and wherein the lockdown screw is disposed within the horizontal aperture; and a sleeve movably disposed in the recess in the inner wall of the spool, wherein the sleeve comprises a body and a resistance element, wherein the body has an inner surface and an outer surface, wherein the body has the concave curvature, wherein the body is held in place in an upper portion of the recess of the spool by the resistance element prior to commencement of a field operation, wherein the lockdown screw abuts against the outer surface of the body when the sleeve is disposed in the upper portion of the recess prior to the commencement of the field operation, and wherein the sleeve is configured to move to a lower portion of the recess during the commencement of the field operation to release the lockdown screw; and stimulating the wellbore after the commencement of the field operation, wherein the sleeve protects the lockdown screw while stimulating the wellbore.

20. The method of claim 19, further comprising:

tripping a hanger inside the wellhead assembly during the commencement of the field operation, wherein the hanger moves the sleeve downward to the bottom portion of the recess of the spool to release the lockdown screw and allow the lockdown screw to engage with a top end of the hanger.

* * * * *